US007946393B2

(12) United States Patent
Thumm

(10) Patent No.: US 7,946,393 B2
(45) Date of Patent: May 24, 2011

(54) SAFETY EVALUATION AND CONTROL SYSTEM FOR ELEVATOR UNITS

(75) Inventor: Gerhard Thumm, Filderstadt (DE)

(73) Assignee: Thyssenkrupp Elevator AG, Dusseldorf (DE)

( * ) Notice: Subject to any disclaimer, the term of this patent is extended or adjusted under 35 U.S.C. 154(b) by 806 days.

(21) Appl. No.: 11/813,504

(22) PCT Filed: Dec. 27, 2005

(86) PCT No.: PCT/EP2005/014043

§ 371 (c)(1),
(2), (4) Date: Jan. 9, 2008

(87) PCT Pub. No.: WO2006/072428

PCT Pub. Date: Jul. 13, 2006

(65) Prior Publication Data

US 2008/0135342 A1 Jun. 12, 2008

(30) Foreign Application Priority Data

Jan. 7, 2005 (EP) ..... 05000289

(51) Int. Cl.
*B66B 1/34* (2006.01)

(52) U.S. Cl. ..... 187/393; 187/287

(58) Field of Classification Search ..... 187/277, 187/286, 287, 288, 293, 295, 296, 297, 305, 187/391–393

See application file for complete search history.

(56) References Cited

U.S. PATENT DOCUMENTS

| | | | | |
|---|---|---|---|---|
| 4,263,988 | A * | 4/1981 | Inaba et al. | |
| 5,135,081 | A * | 8/1992 | Watt et al. | 187/394 |
| 6,164,416 | A * | 12/2000 | Laine et al. | 187/284 |
| 7,117,979 | B2 * | 10/2006 | Angst et al. | 187/351 |
| 7,228,943 | B2 * | 6/2007 | Kugiya et al. | 187/393 |
| 7,353,916 | B2 * | 4/2008 | Angst | 187/393 |
| 7,438,158 | B2 * | 10/2008 | Heinzer et al. | 187/248 |
| 7,533,763 | B2 * | 5/2009 | Kattainen et al. | 187/394 |
| 7,540,358 | B2 * | 6/2009 | Okamoto et al. | 187/394 |
| 7,562,747 | B2 * | 7/2009 | Marchesi | 187/391 |
| 7,575,100 | B2 * | 8/2009 | Kugiya et al. | 187/305 |
| 2005/0279584 | A1 * | 12/2005 | Reuter et al. | |
| 2008/0202862 | A1 * | 8/2008 | Dudde et al. | 187/393 |

FOREIGN PATENT DOCUMENTS

| | | | |
|---|---|---|---|
| JP | 8240607 | A * | 9/1996 |
| JP | 2003104648 | A | 4/2003 |
| WO | 2004028947 | A1 * | 4/2004 |
| WO | 2004043841 | A1 * | 5/2004 |

* cited by examiner

*Primary Examiner* — Jonathan Salata
(74) *Attorney, Agent, or Firm* — Lathrop & Gage LLP

(57) ABSTRACT

The invention relates to an elevator unit including an elevator car which is movable in an elevator shaft and is equipped with a braking device and a catching device encompassing catching elements. The elevator unit further includes a system for detecting signals used for determining an absolute position of the elevator car, a control circuit for detecting signals used for determining the speed or deceleration of the elevator car, and a circuit for evaluating the signals of the detection system and the control circuit. Based on the input signals, the evaluation circuit evaluates whether the speed of the elevator car lies within a predefined interval in the determined position and causes the braking device to be actuated via a first output of the evaluation circuit and/or the catching device to be triggered via a second output of the evaluation circuit according to the result of the evaluation.

20 Claims, 5 Drawing Sheets

SAFETY EVALUATION AND CONTROL SYSTEM FOR ELEVATOR UNITS

RELATED APPLICATIONS

This application claims the benefit of priority to PCT/EP2005/014043, filed 27 Dec. 2005, which claimed priority to European patent application serial number 05000289.8, filed 7 Jan. 2005; each of these applications is incorporated herein by reference.

FIELD

The present invention relates to an elevator unit and a control device for an elevator unit.

BACKGROUND

Elevator units comprise an elevator car which is movable in an elevator shaft. It is common to install buffers as safety devices in a pit of the elevator shaft, in order to decelerate the elevator car as it travels past the lowest stop (or the counterweight as it travels past the topmost stop) in the event of malfunction of the drive. In elevators with high nominal speeds, very large buffers are required for this purpose. Large buffers require a deep pit, which is expensive to construct. Use of buffers satisfies safety regulations which prescribe that the elevator unit must be designed and constructed so as to prevent the car from crashing in the elevator pit (see, e.g., European Safety Standard EN81).

In order to be able to make the buffers and hence the pit smaller, deceleration control circuits have already been proposed which allow the use of smaller single-use buffer devices as described for example in DE 20104389 U1 and DE 1021063 A1.

An excess speed detector with a plurality of light barriers arranged on the elevator car is already known from EP 0712804 B1. The light barriers generate measurements using a measuring strip attached to one side of the elevator shaft, and the speed or deceleration of the elevator car can be determined using these measurements. The measuring strip is of a redundant construction and consists of a marking track and a control track.

Moreover, in addition to the braking device provided for the elevator car, it is conventional and known to provide a catching device for emergencies, and this catching device comprises, in particular, catching wedges (cf. DE 29912544 U1).

SUMMARY

A goal of the invention is to provide an elevator unit in which the buffer device and hence the pit of the shaft can be made smaller or eliminated. Accordingly, an elevator unit, a control device, and a method for controlling an elevator unit are disclosed.

The elevator unit according to the invention and/or the control device according to the invention may operate as a reliable two-stage electronic system, thereby opening up the possibility of doing away with a safety buffer altogether or in part (by "in part", it is meant that a smaller buffer could be provided, e.g. a cheap single-use buffer made of polyurethane, which is provided only for conceivable extreme cases). Thus, using the system according to the invention, existing buffer systems may consequently be made still smaller.

The invention essentially comprises three components, namely a detection system for determining the absolute position of the elevator car, a deceleration control circuit for detecting signals used for determining the speed or deceleration of the elevator car, and, as a third component, an evaluating circuit for processing the signals supplied by the detection system and the deceleration control circuit. This is a so called redundant/diverse system. The redundant/diverse evaluation according to the invention is achieved by means of a two-channel evaluating circuit, wherein a first and a second sensor for detecting relevant signals are each connected in redundant/diverse manner to one of the two channels of the evaluating circuit and a third sensor for an (additional) two-out-of-three selection is connected to both channels of the evaluating circuit.

One advantage achieved with the present invention is that a buffer of the kind described above may be omitted entirely, as the procedure according to the invention ensures reliable and unambiguous detection of the position of the elevator car in addition to determining its speed. Total replacement of a buffer may result in a very great space saving; for example, large (high-rise) elevator units commonly have corresponding car speeds of 6 to 7 meters/second and a buffer height of up to 8 or 9 meters.

The safety evaluation features of the invention can therefore always advantageously be used whenever the elevator car has to be maintained at a certain spacing from an object located below or above it. In most cases, this object will be the pit of the shaft or the ceiling of the shaft, but it may also be a second elevator car travelling in the same elevator shaft underneath the elevator car (e.g., a TWIN® system of the present Applicant).

Further features and embodiments of the invention will become apparent from the description and the accompanying drawings.

BRIEF DESCRIPTION OF THE DRAWINGS

It will be understood that the features described above and those to be explained hereinafter can be used not only in the particular combinations specified but also in other combinations or on their own without departing from the scope of the present invention.

The invention is schematically shown by means of an embodiment shown in the drawings and is described in detail hereinafter with reference to the drawings.

DETAILED DESCRIPTION OF THE INVENTION

As already mentioned herein, the system according to the invention essentially comprises three components.

The first of these components is a detection system for detecting signals for determining an absolute position of the elevator car. A detection system of this kind may operate for example on the basis of a magnetic strip having a plurality of pole divisions arranged in a non-repeating pattern. Magnetic strips of this kind are known per se and are described for example in DE 19732713 A1 and DE 10234744 A1. German Patent Application 102004037486.4, which is incorporated herein by reference, also describes a double signal band for determining the state of motion of a moving body.

Figure 1A:
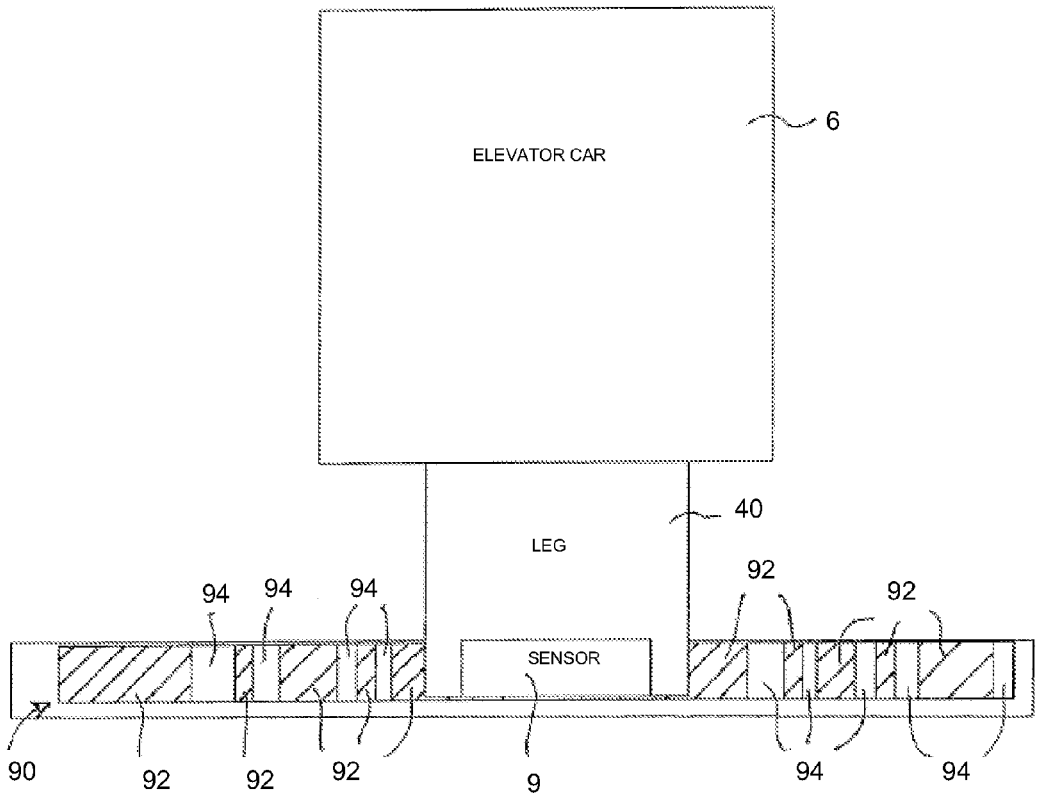
FIG. 1*a* shows a plan view of an arrangement for detecting signals for determining the absolute position of an elevator car.
Figure 1B:
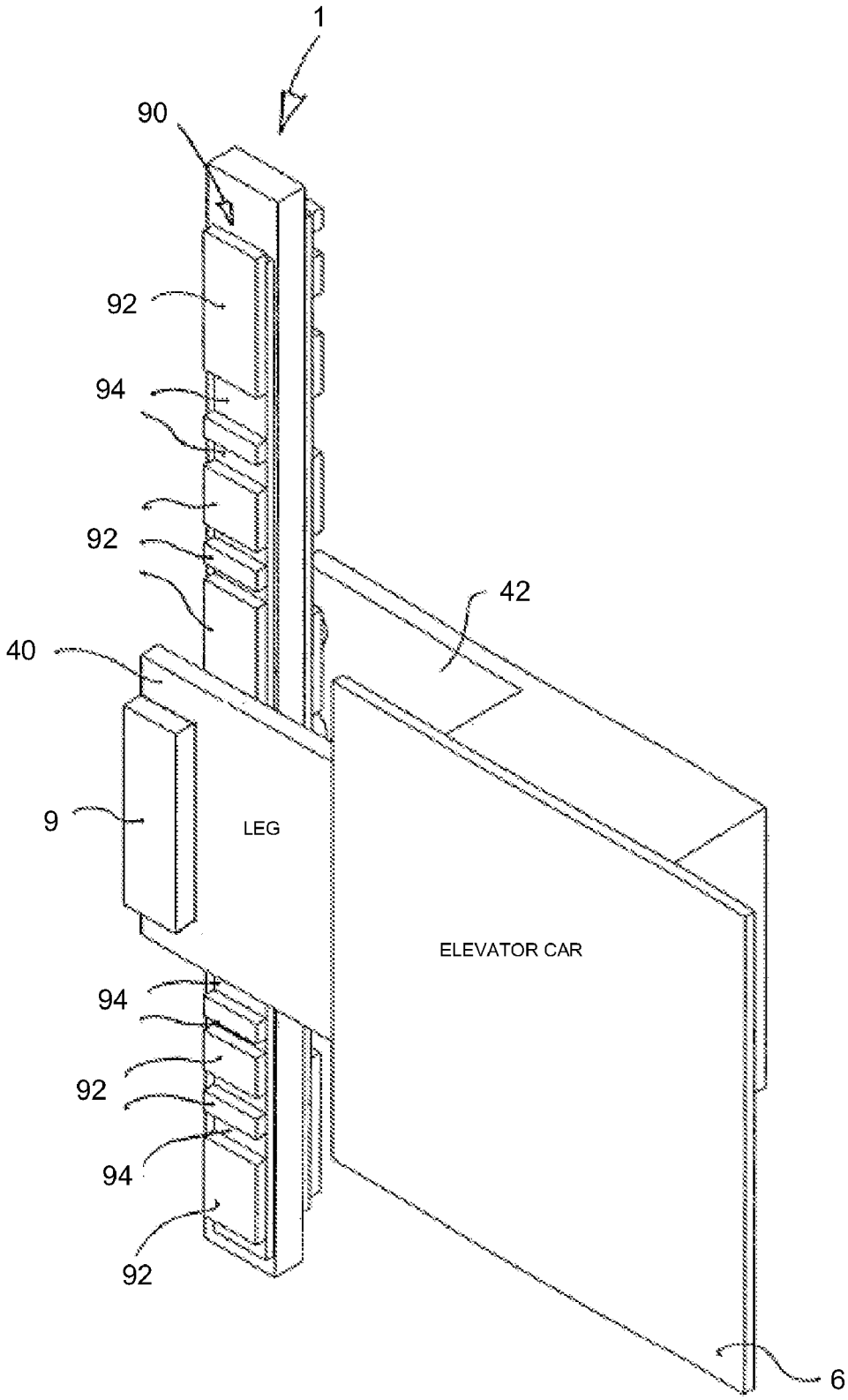
FIG. 1*b* shows the arrangement of FIG. 1*b* in perspective view.

A magnetic strip 90 of this kind which is suitable for performing the invention is shown in FIGS. 1*a* and 1*b*. The magnetic strip 90 comprises a plurality of pole divisions 92, 94 which are arranged in a non-repeating and hence unambiguous pattern. A magnetic sensor 9, such as a Hall sensor, is arranged on the elevator car 6 (not shown in detail), and without making contact, it "reads" the pattern of the magnetic strip 90, which is fixedly mounted in the elevator shaft (e.g., magnetic strip 90 is mounted in a recess in the elevator rails (not shown)). In addition to the absolute position, the speed of the elevator car 6 can also be derived from the signal supplied by the magnetic sensor 9. Naturally, there are other methods familiar to those skilled in the art for determining the absolute position of an elevator car, which can be used within the scope of this invention (e.g., a laser measuring system operating on the principle of a bar code reader).

Figure 2A:
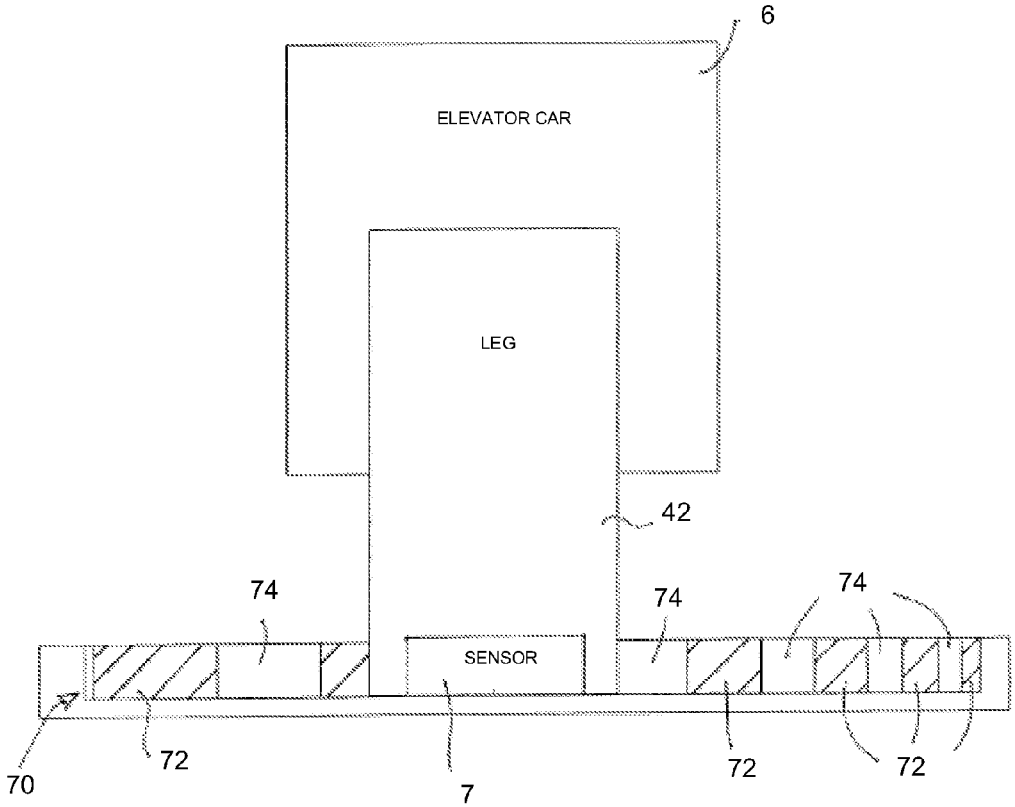
FIG. 2*a* shows a plan view of an arrangement for detecting signals for determining the speed or deceleration of an elevator car for a deceleration control circuit.
Figure 2B:
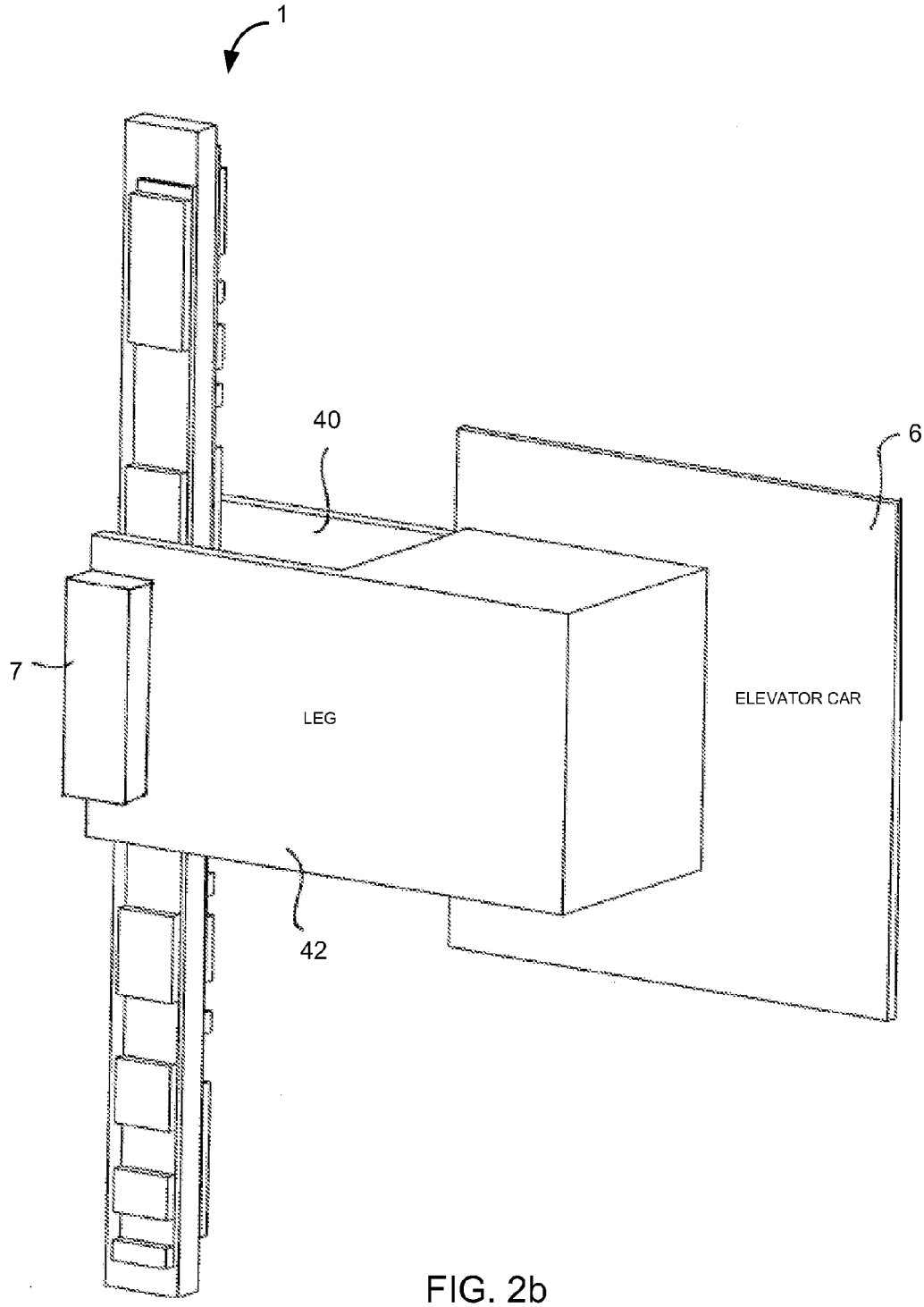
FIG. 2*b* shows the arrangement of FIG. 2*b* in perspective view.

The second of the components mentioned above is a control circuit. FIGS. 2*a* and 2*b* show an arrangement which serves to detect signals in order to determine the speed or deceleration of an elevator car for the control circuit. This arrangement comprises a strip 70 on which a pattern 72, 74 is provided, wherein the pattern is capable of being detected by a sensor 7. The strip is fixedly mounted in the elevator shaft in the region of the deceleration section of the elevator car 6 (e.g., above the pit or below the ceiling of the shaft, as the invention can equally be used above the pit or in the safety region at the top end of the shaft). The pattern of the alternating sensor-relevant measuring sections 72, 74 on the strip 70 is selected so that the detected signals produce a constant time value, i.e. the individual measuring sections 72, 74 become steadily shorter towards the upper end of the elevator shaft. Any inordinate deceleration of the elevator car can thus easily be detected by an evaluation as a result of deviation from the constant desired time value.

The strip 70 for detecting signals in order to determine the speed or deceleration of an elevator car can be produced in a number of ways known to the skilled man, e.g. by means of a metal strip stamped with perforations, the pattern of which is detected by a forked light barrier, or by magnetic pole divisions or optical reflective sections.

As can be seen from the perspective views in FIGS. 1*b* and 2*b*, the two measuring strips 70, 90 for the two components described can be provided on the front and back of a carrier 1 (e.g., in the recess of an elevator rail), and the associated sensors 7 and 9 for the two strips 70 and 90, respectively, can be respectively provided on the legs 42 and 40 of a U-shaped element on the elevator car. The legs 42, 40 surround the carrier 1 of the strips 70, 90 and thus allow the strips 70, 90 to be simultaneously read by the associated sensors 7, 9.

Figure 3:
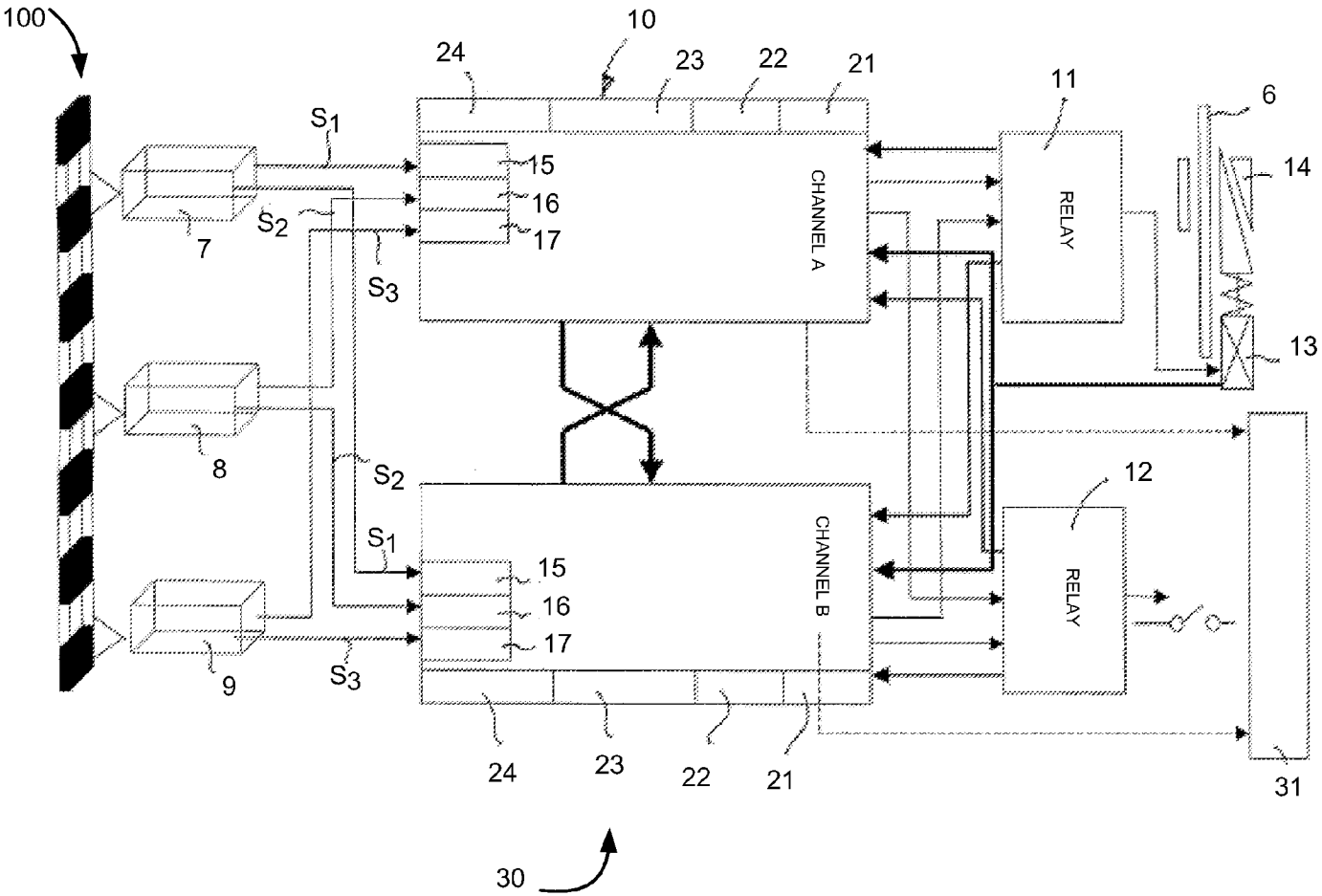
FIG. 3 shows a structural diagram of an evaluating circuit.

The third component is an evaluating circuit 30 as shown by way of example in FIG. 3. The evaluating circuit 30 may take the form of a microcontroller 10 which is electrically connected to a braking device and a catching device. The evaluating circuit 30 constitutes the core of a control device according to the invention.

Attached to the microcontroller 10 are a safety relay device in the form of a first safety relay 11 and a second safety relay 12, a braking device (not shown) and an actuator 13 connected to the first safety relay 1, said actuator 13 actuating a catching device 14. Shown on the left of FIG. 3 in highly schematic form are the two measuring strips which are hereinafter referred to as the double signal strip 100, for short, in the interest of simplicity. Shown together with double signal strip 100 are sensor devices 7 to 9, the sensor devices 7 to 9 being mounted on the outside of the elevator car as already mentioned and travelling past the double signal strip 100 when the elevator car is in motion.

For reliably detecting the speed, two redundant/diverse sensors 7 and 9 with corresponding two-channel evaluation are sufficient per se. In order to operate the elevator unit with the minimum possible disruption, a third sensor 8 may be provided according to an additional embodiment of the invention in order to detect the speed and position of the elevator car. Thus, a "2 out of 3 selection" is possible, and in this way, transitory fault signals produced by electromagnetic influences (e.g., transitory fault signals causing the unit to come to an immediate standstill) are prevented.

The electrical output signals S1 to S3 from the sensors 7, 8, 9 are fed into the microcontroller 10. The microcontroller 10 has a first channel A and a second channel B. Moreover, an elevator control 31 may be provided, as shown on the right in FIG. 3; elevator control 31 (if provided) is separately connected to the microcontroller 10 and to the first and second safety relays 11, 12.

The first safety relay 11 and the second safety relay 12 are each attached to the first channel A and to the second channel B of the microcontroller 10. The first safety relay 11 is coupled to the actuator 13 which actuates the catching device 14; the first safety relay 11 can thereby initiate the catching device 14. The second safety relay 12 acts on the braking device (not shown) and can trigger the braking device when a corresponding control signal is received.

Each of the channels A and B comprises three input modules 15 to 17 to which the electrical signals S1 to S3 of the relevant sensor devices 7 to 9 are applied. To increase the operational reliability of the apparatus, these two channels are formed with different hardware (e.g., by means of two different processors). Each channel of the microcontroller 10 may have a RAM 21, a flash memory 22, an EEPROM 23, an OSC Watchdog 24, a CAN module and individual separate input modules 15 to 17. The hardware construction of the microcontroller 10 corresponds to a standard commercial electronic component of a kind which is industrially available, and therefore its construction and its internal computing process will not be described in more detail.

The electrical signals from the two sensor devices 7 and 8 for detecting the speed are each applied to the modules 15 and 16 of a respective channel A, B. A corresponding calculation is carried out on the signals applied to the modules, from which the actual speed of the elevator car 6 can be determined. The process of determining the actual speed is restricted to a simple measurement of the time taken to travel a measured distance. If this time is greater than a reference time permanently stored in channels A and B, the speed is within a safe range. The different lengths of the measured sections, which become shorter and shorter towards the end of the shaft, also necessarily provide a direct association with the position of the elevator car.

Each of the channels A and B also comprises an interface 17, which may be constructed as a parallel or serial input. The sensor 9 connected to these inputs provides absolute positional information and further information as to the speed of the elevator car in the shaft.

In the memory areas of the channels A and B, a reference speed is stored for each position in the range of deceleration distances, this reference speed having been stored by means of a calibration process when the elevator unit was installed. These reference speed values are thus dependent on the deceleration selected and the jerking of the elevator unit in question. In a simple standard unit, these values may also already be permanently programmed on delivery. This stored reference speed is compared, in the deceleration range, at every new position of the elevator car supplied by the sensors 7 to 9, with the speed actually traveled, measured by the sensors 7 to 9. If a fixed or adjustable tolerance threshold of the actual speed traveled is exceeded, the second safety relay 12 is actuated, thereby causing the operating brake to come into play.

If a second tolerance threshold is exceeded or if the braking device fails, the first safety relay 11 is also actuated, which in turn triggers the actuator and thereby actuates the catching device for the elevator unit.

All the reference values are stored in a safe storage area and are constantly monitored for their correctness using memory testing procedures known per se. To increase the operational reliability still further, the first channel A and the second channel B may be continuously compared with one another to provide a comparison of the computed variables of the first channel A and second channel B. The comparison may be used to detect differences in the electrical signals of the sensor devices 7 to 9 (e.g., due to faults) at the earliest possible opportunity.

The first safety relay 11 and the second safety relay 12 are operated with separate circuits, for safety reasons. A plurality of safety relays may also be connected to each channel of the microcontroller 10, and these safety relays are analogously operated with separate circuits. The respective safety relays 11, 12 are electrically connected to the individual channels A, B of the microcontroller 10. Such connections allow channels A, B to apply control signals to the corresponding safety relays 11, 12, as will be explained hereinafter, and further allow safety relays 11, 12 to send return feedback information to the microcontroller 10.

The first safety relay 11 is coupled to the actuator 13 which actuates the catching device 14, as explained above. The catching device 14 may be a wedge device, known per se, which is driven between a guide rail of the elevator unit and an edge region of the elevator car in order to stop the elevator car in an emergency. When the car 6 is stationary, the actuator can also be activated and deactivated by an electrical signal for testing purposes. After the testing operation has ended, normal operation of the elevator unit can be resumed.

After the braking device has been initiated by a control signal from the second safety relay 12 or after the catching device 14 has been actuated by a control signal from the first safety relay 11, further operation of the apparatus according to the invention is not possible until an operational check has been carried out by qualified personnel. Once the check is complete, a corresponding release signal is sent from the respective safety relay 11 or 12 back to the corresponding channel A, B, after which normal travel of the elevator unit can continue.

The device explained herein ensures, by means of cooperation among the double signal strip 100, electrical components, and magnetic or optical components, effective speed limitation or speed control of the elevator car. The apparatus can thus replace conventional mechanical safety systems for speed limitation, i.e. safety buffers. Similarly, conventional electrical deceleration control circuits, which are generally used in conjunction with oil buffers in elevator units intended to operate at higher speeds, can be replaced by the safe detection of deceleration provided according to the invention.

In the light of the safety concept explained above, the apparatus may meet elevator guideline requirements.

The invention claimed is:

1. Elevator unit with an elevator car movable in an elevator shaft, the elevator unit comprising:

a braking device for slowing the elevator car;

a catching device having catching elements for stopping the elevator car;

a first sensor for generating electrical signals in cooperation with a first measuring strip, the electrical signals representing a speed of the elevator car;

a second sensor for generating electrical signals representing the speed and an absolute position of the elevator car;

a third sensor for generating electrical signals representing the speed and the absolute position of the elevator car; and an evaluation circuit including first and second channels, each channel electrically connected to the first, second and third sensors, each channel operable to evaluate the electrical signals generated by the third sensor and one of the first and second sensors to determine the absolute position and the speed of the elevator car, the evaluation circuit being operable to activate the braking device via a first output of the evaluation circuit if the speed of the elevator car exceeds a preset range at the absolute position and activate the catching device via a second output of the evaluation circuit if the absolute position and the speed of the elevator car continue to deviate from desired values after activation of the braking device, and the evaluation circuit being operable to continuously compare variables computed by the first and second channels.

2. Elevator unit according to claim 1, wherein the second sensor generates electrical signals in cooperation with a continuous second measuring strip arranged in the elevator shaft.

3. Elevator unit according to claim 1, wherein the second sensor generates electrical signals in cooperation with a second measuring strip arranged in the elevator shaft, the second measuring strip having a defined, non-repeating pattern.

4. Elevator unit according to claim 2, wherein the second measuring strip is a magnetic strip with a pole division pattern.

5. Elevator unit according to claim 1, wherein the first measuring strip is arranged in the elevator shaft, the first measuring strip having a pattern defined by measurement sections, the measurement sections becoming shorter towards an end of the first measuring strip.

6. Elevator unit according to claim 1, wherein:

the first measuring strip has a pattern defined by measurement sections that become shorter towards an end of the first measuring strip, the second sensor generates electrical signals in cooperation with a continuous second measuring strip arranged in the elevator shaft, and the first and second measuring strips respectively form front and rear sides of a double signal strip.

7. Control device for limiting a speed of an elevator car of an elevator unit, comprising:

an evaluation circuit including two channels, each channel having three input modules operable to respectively receive a first, second, and third electrical input signal, the first electrical input signal representing the speed or a deceleration of the elevator car, the second and third input signals representing the speed and an absolute position of the elevator car;

wherein each channel is operable to determine the absolute position of the elevator car and one of the speed and the deceleration of the elevator car via the third input signal and one of the first and second input signals;

wherein the control device is operable to activate a braking device to slow the elevator car if the absolute position and the speed of the elevator car deviate from desired values, and wherein the control device is operable to activate a catching device to stop the elevator car if the absolute position and the speed of the elevator car continue to deviate from the desired values after activation of the braking device.

8. Method for controlling an elevator unit having an elevator car moveable in an elevator shaft, comprising:

detecting parameters of the elevator car from three sensors, the parameters including an absolute position of the elevator car and one of a speed and a deceleration of the elevator car;

receiving the parameters in first and second channels of an evaluation circuit;

comparing the parameters to desired values; and performing the following steps if the parameters deviate from the desired values by more than a permitted tolerance:

triggering a braking device, repeating the step of detecting the parameters, repeating the step of comparing the parameters with the desired values, and triggering a catching device of the elevator unit if the parameters deviate from the desired values by more than the permitted tolerance.

9. Elevator unit having an elevator car movable in an elevator shaft, comprising:

a braking device for slowing the elevator car;

a catching device with catching elements for stopping the elevator car;

a detecting system for generating electrical signals representing an absolute position of the elevator car from a first sensor and a third sensor;

a control circuit for generating electrical signals representing one of a speed and a deceleration of the elevator car from a second sensor and the third sensor; and an evaluation circuit having two channels operable to evaluate the electrical signals generated by the detecting system and the control circuit to determine the absolute position of the elevator car and one of the speed and the deceleration of the elevator car, wherein the evaluation circuit determines whether the speed of the elevator car at the absolute position is within a preset range, and wherein the evaluation circuit activates the braking device via a first output of the evaluation circuit if the speed of the elevator car is outside the preset range at the absolute position and activates the catching device via a second output of the evaluation circuit if the absolute position and the speed of the elevator car continue to deviate from desired values after activation of the braking device.

10. Elevator unit according to claim 9, wherein the detecting system comprises a measuring strip arranged in the elevator shaft, the measuring strip having a defined, non-repeating pattern.

11. Elevator unit according to claim 10, wherein the measuring strip is a magnetic strip with a pole division pattern.

12. Elevator unit according to claim 9, wherein the control circuit comprises a measuring strip arranged in the elevator shaft, the measuring strip having a pattern defined by measuring sections, the measuring sections becoming shorter towards an end of the measuring strip.

13. Elevator unit according to claim 9, wherein:

the detecting system comprises a first measuring strip arranged in the elevator shaft, the first measuring strip having a defined, non-repeating pattern, the control circuit comprises a second measuring strip arranged in the elevator shaft, the second measuring strip having a pattern defined by measuring sections, the measuring sections becoming shorter towards an end of the measuring strip, and the first and second measuring strips respectively form front and rear surfaces of a double signal strip.

14. Control device for limiting a speed of an elevator car of an elevator unit, comprising:

an evaluation circuit including two channels, each channel operable to respectively receive first and second electrical input signals, the first electrical input signal from a first sensor and a third sensor representing one of the speed and a deceleration of the elevator car, the second electrical input signal from a second sensor and the third sensor representing an absolute position of the elevator car;

wherein each channel is operable to determine the absolute position of the elevator car and one of the speed and the deceleration of the elevator car via the first and second electrical input signals;

wherein the control device is operable to activate a braking device to slow the elevator car if the absolute position and the speed of the elevator car deviate from desired values, and wherein the control device is operable to activate a catching device to stop the elevator car if the absolute position and the speed of the elevator car continue to deviate from the desired values after activation of the braking device.

15. Elevator unit according to claim 3, wherein the second measuring strip is a magnetic strip with a pole division pattern.

16. Elevator unit according to claim 1, wherein:

the first measuring strip has a pattern defined by measurement sections that become shorter towards an end of the first measuring strip, the second sensor generates electrical signals in cooperation with a second measuring strip arranged in the elevator shaft, the second measuring strip having a defined, non-repeating pattern, and the first and second measuring strips respectively form front and rear sides of a double signal strip.

17. Method of claim 8, wherein:

the steps of detecting and comparing are performed by the first and second channels of an evaluation circuit, the first channel of the evaluation circuit determines the speed and the absolute position of the elevator car from a first and a third input signal, the second channel of the evaluation circuit determines the speed and the absolute position of the elevator car from a second and the third input signal, the first input signal represents one of the speed and the deceleration of the elevator car, the second input signal represents the speed and the absolute position of the elevator car, and the third input signal represents the speed and the absolute position of the elevator car.

18. Method of claim 17, the evaluation circuit being operable to determine the speed and the absolute position of the elevator car from any two of the first, second, and third input signals.

19. Elevator unit according to claim 1, the evaluation circuit being operable to determine the absolute position and the speed of the elevator car by evaluating the electrical signals generated by any two of the first, second, and third-sensors.

20. Control device according to claim 7, the control device being operable to determine the absolute position of the elevator car and one of the speed and the deceleration of the elevator car via any two-of the first, second, and third input signals.

* * * * *